US010106864B2

(12) United States Patent
Zeng et al.

(10) Patent No.: US 10,106,864 B2
(45) Date of Patent: Oct. 23, 2018

(54) METHOD AND APPARATUS FOR LASER QUENCHING

(71) Applicants: WUHAN NRD LASER ENGINEERING CO., LTD, Wuhan (CN); HUAZHONG UNIVERSITY OF SCIENCE AND TECHNOLOGY, Wuhan (CN)

(72) Inventors: Xiaoyan Zeng, Wuhan (CN); Qianwu Hu, Wuhan (CN); Yinlan Zheng, Wuhan (CN); Ming Jiang, Wuhan (CN); Chongyang Li, Wuhan (CN); Zhao Ren, Wuhan (CN); Kun Li, Wuhan (CN)

(73) Assignee: WUHAN HIVALUE INTELASER LTD., Ezhou (CN)

( * ) Notice: Subject to any disclaimer, the term of this patent is extended or adjusted under 35 U.S.C. 154(b) by 548 days.

(21) Appl. No.: 14/765,516

(22) PCT Filed: Nov. 7, 2013

(86) PCT No.: PCT/CN2013/086691
§ 371 (c)(1),
(2) Date: Nov. 23, 2015

(87) PCT Pub. No.: WO2014/121621
PCT Pub. Date: Aug. 14, 2014

(65) Prior Publication Data

US 2016/0076115 A1 Mar. 17, 2016

(30) Foreign Application Priority Data

Feb. 6, 2013 (CN) ..... 2013 1 0047363

(51) Int. Cl.
*C21D 1/09* (2006.01)
*C21D 1/70* (2006.01)

(52) U.S. Cl.
CPC *C21D 1/09* (2013.01); *C21D 1/70* (2013.01)

(58) Field of Classification Search
CPC ..... C21D 1/09; C21D 1/70
See application file for complete search history.

(56) References Cited

U.S. PATENT DOCUMENTS 6,085,122 A 7/2000 Manning
2003/0080098 A1* 5/2003 Yamazaki ..... B23K 26/0626 219/121.62
2016/0076115 A1* 3/2016 Zeng ..... C21D 1/09 148/565

FOREIGN PATENT DOCUMENTS

CN 101403030 A 4/2009
CN 103215411 A 7/2013
(Continued)

*Primary Examiner* — Scott R Kastler
(74) *Attorney, Agent, or Firm* — Davis Wright Tremaine LLP

(57) ABSTRACT

Provided are a method and an apparatus for laser quenching. The method utilizes a scanning galvanometer, and involves laser quenching via irradiation with intermittent, repeated scans, rather than a single scan as in the prior art. The method results in increased laser energy absorbed by the metal base and improved depth of thermal conduction, while avoiding melting at the metal surface, thus providing a significantly improved laser quenching process. The apparatus can include a laser, a control system, a light guiding system, a mechanical motion device and a galvanometer.

13 Claims, 7 Drawing Sheets

(56) References Cited

FOREIGN PATENT DOCUMENTS

| | | | |
|---|---|---|---|
| JP | 57-098620 | A | 6/1982 |
| JP | 58-091117 | A | 5/1983 |
| JP | 61-079715 | A | 4/1986 |

* cited by examiner

METHOD AND APPARATUS FOR LASER QUENCHING

CROSS-REFERENCE TO RELATED APPLICATIONS

The present application is a U.S. National Stage entry under 35 U.S.C. § 371 of International Application No. PCT/CN2013/086691, filed on Nov. 7, 2013, designating the United States of America and published in Chinese on Aug. 14, 2014, which in turn claims priority to Chinese Application No. 2013100473636, filed on Feb. 6, 2013, each of which is hereby incorporated by reference in its entirety.

FIELD OF THE INVENTION

The present invention relates to the laser surface hardening treatment technology, and more particularly to a method and an apparatus for laser quenching on repeated scans based on a scanning galvanometer, and the invention is particularly suitable for quenching a surface of a large-sized metal workpiece.

BACKGROUND OF THE INVENTION

Laser quenching technology, also known as laser heat treatment or laser transformation hardening process, employs a laser beam to irradiate a metal workpiece, enabling surface temperature thereof to rise above austenitizing temperature $T_a$. After removal of the laser beam, temperature of the laser treated region drops below the temperature of martensitic transformation quickly, and a martensitic hardened layer is formed in the surface area because the cooling rate of the heated region is greater than the critical cooling rate of quenching due to rapid heat conduction of the base material which is still in the room temperature for it is not heated directly. Laser quenching belongs to a self-cooling quenching process for its rapid cooling rate and absence of cooling mediums such as water and oil.

Generally, the laser quenching process is classified into two categories: one is known as laser transformation hardening or laser heat treatment process, in which a metal surface does not melt and only a solid-state transformation occurs after laser irradiation, and its primary feature is to ensure that the maximum temperature of the metal surface is below its melting temperature $T_m$ during laser irradiation, therefore, process parameters of the laser quenching (including laser power, spot size, scanning speed, etc.) should be properly selected. The other is known as melting laser quenching process, in which the temperature of a metal surface may now exceed its melting point and the surface may be melted after laser irradiation. Since a surface of a workpiece is melted, a higher laser power and a slower scanning speed can be used, besides, the hardened layer is deeper than that of a typical laser quenching process. However, the melting laser quenching process significantly alters surface roughness of the metal material, so use thereof is limited in circumstances where a high precision is required and a subsequent machining is forbidden. Sometimes, a local micro-melting may occur in the surface of a metal workpiece due to improper selection and fluctuation of process parameters, and the micro-melting layer can be removed by polishing or grinding. The process is generally still attributed to the laser quenching process. Unless specified otherwise, the laser quenching described hereinafter refers to the process of solid-state transformation hardening in which a metal material hardly melts or only local micro-melting occurs.

A depth of a hardened layer by laser quenching is not only related to process parameters such as laser power, scanning speed and spot size, but also related to the thermal conductivity and the hardenability of a metal. For a specific metal material, its austenitizing temperature $T_a$ and melting temperature $T_m$ are approximately stable and only vary with fluctuations of microstructures and the uniformity of the overall composition. Generally, the conduction depth of a metal workpiece with a temperature higher than the austenitizing temperature $T_a$ determined by laser process parameters and the procedure of heat conduction corresponds to the depth of a hardened layer by laser quenching.

The depth of a hardened layer by laser quenching is not only related to parameters of laser quenching process, but also related to the thermal conduction process of the base of a metal material, and particularly closely related to the thermal conductivity of the material, which is jointly determined by parameters of laser quenching process and the thermal conduction properties of the base. During laser quenching, laser output modes include continuous output and pulsed output scanning quenching. The thermal conduction process of a existing scanning laser quenching, either continuous or pulsed laser quenching, can be analyzed by the thermal conduction equation of a continuously fixed point-like heat source, and the equation of the thermal conduction temperature is as follows:

$$T(R, t) = \frac{p}{2\pi\lambda R}\left[1 - \phi\left(\frac{R}{\sqrt{4at}}\right)\right] \tag{1}$$

In formula (1), R is the distance from a point to a heat source; T(R,t) is the temperature of a point in the surface of a workpiece at a distance R from the heat source at a time t; p is the effective power of the heat source; t is the thermal conduction time in the metal; $\lambda$ is the thermal conductivity of the metal; a is the thermal diffusivity of the metal; and $\phi(u)$ is a probability integral function. When $t=\infty$, the heating time of the heat source can be considered to be infinite, thus $\phi(u)=0$, and the ultimate supersaturation temperature $T_{sp}$ of a point at a distance R from the laser point source is as follows:

$$T_{sp} = \frac{p}{2\pi\lambda R} \text{ or} \tag{2}$$

$$R = \frac{p}{2\pi\lambda T_{sp}} \tag{3}$$

Where $T_{sp}$ is proportional to the inputted laser energy, and is inversely proportional to the distance R from the heat source. For laser quenching process, it is obvious that $T_{sp}$ should not exceed the melting point of a metal material. Since it is necessary that the temperature of a heated region should exceed the austenitizing temperature to form a laser hardened layer, $T_{sp}>T_a$. Therefore, a prerequisite for laser quenching to obtain a martensite is that the range of the temperature of a laser heated region $T_{sp}$ is as follows: $T_m>T_{sp}>T_a$.

According to the equation of heat conduction (1) and the equation of heat conduction (2) or (3) under the condition of ultimate supersaturation, the following conclusions can be derived:

(1) The longer the time of laser heating, or the higher the injected energy density, or the greater the laser beam absorptivity of a metal material, or the greater the thermal diffusivity of a metal material, the higher the temperature T(R, t) of the metal will be, the deeper the part beneath the surface capable of reaching the austenitizing temperature will be, and correspondingly the greater the depth (R) of the laser hardened layer will be.

(2) After the material for quenching is determined, the depth (R) of the laser hardened layer is closely related to laser power (p), spot size, power density and treating duration.

The process of laser quenching in the prior art always adopts a focused spot for scanning quenching. There are two shapes of laser spots: one is a circular spot; and the other is a rectangular spot obtained by optical shaping. As surface melting is not allowed in laser quenching, neither excessive laser power or laser power density nor excessive treating duration is to be adopted, therefore, the depth of a hardened layer by laser quenching processes in the prior art is extremely limited according to the three equations described above.

In recent years, selective laser quenching process has been used more and more widely. Unlike conventional laser quenching processes hardening the entire surface of a metal workpiece, selective laser quenching process selectively hardens parts of the surface of a material by a laser beam in terms of the requirements of the workpiece properties, namely, the hardened regions do not cover the entire surface of the workpiece, and form a compound soft-and-hard hardened layer or hardened arrays. In this way, better wear resistance and better and toughness of a metal surface can be realized. Nowadays, there are many methods to realize the process of selective laser quenching, such as progressive scanning by multi-axis control of the movement of the laser beam or the workpiece, or combining pulsed laser output and the control of the trajectory of the machine tool. Among them, the pulsed laser quenching process can output a pulsed laser by the shutdown function of a switching power supply directly or by a chopper disk changing a continuous laser beam into a pulsed manner. The latter requires a higher accuracy of the control system of the laser quenching machine tool. In addition, selective laser quenching hardening can also be realized by continuous laser scanning through a mask, then only part of a workpiece can be heated to quench by a laser beam passing through the mask, and parts covered by the mask have no quenching effect. Although the process is simple and does not require a complex control system and programming procedure, it has a relatively low processing efficiency. It must be pointed out that, no matter what kind of method it is, all the existing methods for laser quenching are based on single-scan quenching by a laser beam.

Since no melting in a workpiece surface is allowed in a laser quenching process, and the moving speed of a machine tool is generally low, the laser power and the power density should not be too high, and the quenching speed should also be controlled to a low level if single-scan quenching by a laser beam in prior art is adopted, regardless of continuous laser quenching or pulsed laser quenching. Besides, considering restrictions of thermal conduction properties and the hardenability of the metal material, a laser hardened layer is relatively thin (usually below 1 mm), and the productivity is unable to be improved effectively. With the development of laser devices, the power of solid-state lasers (including fiber lasers) and gas lasers has reached a relatively high level (e.g. the power is 40 kW for fiber lasers and is 20 kW for gas lasers). Those high power lasers can only be used for welding, cutting, cladding, alloying and fusing, in which a material is in a molten state. As for a laser quenching process, both the laser power and the scanning speed should be restricted to a relatively low level to avoid a workpiece melting in the laser quenching process. For example, the typical power of laser quenching is generally 1~3 kW, and the scanning speed is generally 300~2000 mm/min. As a result, laser quenching processes in prior art feature in small depth of a hardened layer and low production efficiency, and is difficult to meet the demand for high efficiency in laser production, which hinders further application of laser quenching.

Therefore, it has become one of the key technical problems for further expanding laser quenching's industrial applications that whether a new breed of laser surface quenching can be developed so as to greatly improve the speed and productivity of laser quenching.

SUMMARY OF THE INVENTION

It is an objective of the invention to provide a method for laser quenching on repeated scans based on a scanning galvanometer that can substantially improve the productivity and the depth of hardening by laser quenching, so as to solve the problems of low productivity and small depth of hardening by laser quenching processes in the prior art. An apparatus to realize the method is also provided in the present invention.

To achieve the above objective, in accordance with one embodiment of the invention, there is provided a method for quenching surface of a metal workpiece by laser on repeated scans, wherein laser quenching is carried out by controlling parameters of a laser quenching process, and a laser beam with a high power density passing through a scanning galvanometer is projected onto a surface of a metal workpiece to perform intermittent repeated irradiation on each processing unit, wherein the processing unit refers to a region on the surface of the metal workpiece that is irradiated by the laser beam passing through the scanning galvanometer in a single continuous treatment under the condition of not moving the scanning galvanometer and the workpiece, one processing unit corresponds to one laser processing pattern, one processing unit or a combination of multiple processing units constitutes a quenching unit, and the pattern of the quenching unit is a complex combined graph formed by laser processing patterns of the processing units or any other graph; and in the whole laser quenching process, the surface of the metal workpiece is heated by the laser beam on intermittent repeated scans instead of on a single scan in prior art using the regulatory function of the scanning galvanometer, laser energy is fed into the surface of the metal workpiece by way of short time and multiple superimposed heating through heat conduction by controlling the duration of heating, the interval of two treatments and the scanning times of the laser quenching process on repeated scans, increase the total inputted laser energy to make temperature of the surface of the metal workpiece rise rapidly and to make temperature of the laser quenching area of the surface of the metal workpiece higher than austenitizing temperature of the metal workpiece while lower than the melting point thereof, a larger depth of hardening is realized by thermal accumulation generated by intermittent laser heating through heat conduction, and therefore a whole laser transformation hardening process is completed and production efficiency of laser quenching is improved, the parameters of the laser quenching process include laser power and spot size, the laser power is 300 W~30000 W and the spot size is 0.5 mm~60 mm.

In a class of this embodiment, said parameters of said laser quenching process further include scanning speed, scanning period, and scanning times, the scanning period refers to the sum of a continuous radiation time and a interval time of the laser beam applied to a processing unit; the scanning times refers to the repeated times of scanning a quenching unit required to reach the desired depth of hardening, the scanning speed is 300 mm/s~8000 mm/s, the size of the processing unit is 1 $mm^2$~30000 $mm^2$, and the scanning times is 2~5000.

In a class of this embodiment, as continuous filling of the quenching unit is required for covering a whole quenching area, the parameters of laser quenching process further include a relative moving speed which refers to the speed of the laser beam moving from one quenching unit to another, and the method for laser quenching includes laser quenching on repeated scans and flying laser quenching on repeated scans.

In a class of this embodiment, the method comprises the steps of:

(1) assuming the total number of quenching units on the workpiece is N, the serial number of a quenching unit being processed on the workpiece is j, the quenching period is T, the required scanning times for a quenching unit is Q, and the actual scanning times is represented by q, wherein the quenching period T equals the product of scanning times and the scanning period within a quenching unit; and the quenching unit refers to a set of processing units irradiated by the laser beam within the quenching period T on the workpiece surface; and setting j=1, q=1, and laser energy distribution in a processing unit is substantially uniform during the whole process of laser quenching;

(2) irradiating an initial position of the jth quenching unit by the laser beam passing through the scanning galvanometer, and recording the time point as $t_0$, scanning each of the processing units in the jth quenching unit once by the laser beam, and proceeding to step (3) once finished;

(3) checking if q equals the predetermined scanning times Q, if yes, then quenching is finished for the jth quenching unit, namely laser transformation hardening has occurred and the desired depth of hardening is reached in each of the processing units in the jth quenching unit, and the process goes to step (4), and if no, q=q+1, setting the current time is t and the scanning period is $T_b$, and returning to step (2) when $t-t_0=T_b$;

(4) checking if j equals N, if yes, then laser transformation hardening has occurred and a hardened region reaching the desired depth of hardening is formed by laser quenching in each of the quenching units, and the process goes to step (5), and if no, setting j=j+1 and returning to step (2); and (5) ending.

In a class of this embodiment, the total number of quenching units on the workpiece is N, the serial number of a quenching unit being processed is j, the required scanning times for a quenching unit is Q, the quenching period is T, the actual scanning times is represented by q, the relative moving speed of the workpiece with respect to the mechanical motion mechanism (including the galvanometer) is v, and the compensatory moving speed of the laser beam passing through the galvanometer is-v, wherein the quenching period T equals the product of scanning times and the scanning period within a quenching unit, and the quenching unit refers to a set of processing units irradiated by the laser beam within the quenching period T on the workpiece surface. The method comprises the steps of:

(1) setting j=1 and q=1;

(2) irradiating an initial position of the jth quenching unit by the laser beam passing through the scanning galvanometer, and recording the time point as $t_0$, scanning each of the processing units in the jth quenching unit once by the laser beam according to designed processing units and a predetermined scanning speed while making the laser beam fly reversely at a speed of −v for compensation, and proceeding to step (3) once finished, and laser energy distribution in a processing unit is substantially uniform during the whole process of laser scanning;

(3) checking if q equals the predetermined scanning times Q, if yes, then quenching is finished for the jth quenching unit, namely laser transformation hardening has occurred and the desired depth of hardening is reached in each of the processing units in the jth quenching unit, and proceeding to step (4), and if no, q=q+1, setting the current time is to t and the scanning period to $T_b$, and returning to step (2) when $t-t_0=T_b$, once the duration of scanning the jth quenching unit equals the scanning period $T_b$, the laser beam jumps from the last processing unit to the first processing unit, and a next cycle of flying laser quenching on repeated scans for the jth quenching unit is activated, the jumping distance equaling the jumping distance of compensatory flying at time $T_b$; and if the duration of scanning the jth quenching unit once is less than the scanning period $T_b$, wait until $t-t_0=T_b$ to activate a next cycle of flying laser quenching on repeated scans;

(4) checking if j equals N, if yes, then quenching is finished for all the quenching units, namely laser transformation hardening has occurred and a hardened region reaching the desired depth of hardening is formed by laser quenching in each of the quenching units, and proceeding to step (5), and if no, setting j=j+1 and returning to step (2); and (5) ending.

In a class of this embodiment, the duration of a laser treatment $t_1$ is 1~10000 ms, the interval of two treatments $t_2$ is 1~10000 ms, and the quenching period T is 2~200000 ms.

In a class of this embodiment, when the laser power is 1000~20000 W, the spot size is 1~30 mm, the scanning speed is 300-8000 mm/s, the size of the processing unit is 1~30000 $mm^2$, the scanning times is 2~5000, the duration of a laser treatment $t_1$ is 1~1000 ms, the interval of two treatments $t_2$ is 1~1000 ms, and the quenching period T is 2~20000 ms.

In a class of this embodiment, the laser power is 1500~15000 W, the spot size is 2~15 mm, the scanning speed is 300~7000 mm/s, the size of the processing unit is 10~15000 $mm^2$, the scanning times is 2~3000, the duration of a laser treatment $t_1$ is 1~500 ms, the interval of two treatments $t_2$ is 1~500 ms, and the quenching period T is 2~10000 ms.

In a class of this embodiment, the laser power is 2000~10000 W, the spot size is 3~10 mm, the scanning speed is 300~5000 mm/s, the size of the processing unit is 15~10000 $mm^2$, the scanning times is 2~1000, the duration of a laser treatment $t_1$ is 1~300 ms, the interval of two treatments $t_2$ is 1~300 ms, and the quenching period T is 2~6000 ms.

By taking advantage of features of the scanning galvanometer, such as high acceleration, high scanning speed and high jumping speed, the present invention adopts the method of heating on multiple or even high frequency repeated scans instead of on a single scan in the prior art for laser quenching, the laser energy is fed into the surface of the workpiece by way of short time and multiple superimposed heating, and the laser energy absorbed by the metal base is increased cumulatively, which can prevent the workpiece surface from melting as a result of overheating on the one hand, and can greatly improve the depth of heat conduction as a result of continuous high temperature of the workpiece surface on the other hand. Therefore, even though the laser power is relative high, the surface temperature of a metal object can be always restricted below its melting point, and the inputted laser energy can be conducted from the surface to the internal of the workpiece by thermal conduction constantly and effectively as a result of high scanning speed, short heating time and the introduce of time interval at scanning, so that melting in the metal surface can be avoided, and the depth of the austenitizing region in the surface of the workpiece and the productivity of laser quenching can be significantly improved.

Specifically, advantages of the present invention are as follows:

(1) Instead of using quenching processing on single laser scan in the prior art, quenching processing on multiple repeated scans enables the maximum temperature on the workpiece surface caused by actually input and accumulated laser energy to be less than the melting point of the metal material by selecting appropriate parameters of laser quenching process (including laser power, scanning speed, scanning period, spot size and scanning times, etc.), and thus preventing substantial melting on the metal surface as a result of absorbing too much energy in a short time.

(2) The productivity of laser quenching can be improved significantly since the scanning galvanometer can realize high scanning speed, high jumping speed and high acceleration, which makes it possible to heat the surface of the metal material by high power laser scanning at a high speed under the condition of not melting the workpiece surface.

(3) The invention is capable of significantly improving laser quenching efficiency by quenching other processing units in the time interval of a processing unit.

(4) In the laser quenching process on repeated scans based on a scanning galvanometer of the present invention, instead of being limited to the smallest focal spot, the spot size can be adjusted in a wide range according to the actual requirements for the workpiece, which can improve the efficiency of laser quenching and the depth of hardening.

(5) Movement lags caused by frequent on-off operations on the mechanical motion device are avoided, and the efficiency of laser quenching is effectively improved as flying laser quenching is adopted.

(6) Compared with laser quenching processes in prior art, the method for laser quenching of the present invention can significantly improve the depth of laser quenching by equal laser power, or can significantly improve the efficiency of laser quenching by higher laser power under the condition of equal quenching time and equal depth of hardening. Therefore, the present invention is capable of breaking through the limits of laser power, laser power density and scanning speed of laser quenching processes in prior art (laser quenching on a single scan), and can solve technical problems of existing laser quenching processes such as small depth of hardening and low productivity.

In summary, the laser quenching process on repeated scans of the present invention takes the advantage of the features of high acceleration, high scanning speed and high jumping speed of the scanning galvanometer, adopts the method of heating on multiple repeated scans instead of on a single scan in prior art, changes the thermal conduction process of laser quenching in prior art, and solves the problems of melting of the metal surface and small depth of hardening caused by laser quenching with a high power density, which can improve the efficiency and the depth of hardening by laser quenching significantly and can effectively solve the problem of low productivity of laser quenching processes in prior art. Therefore, the method of the present invention is of great use in practical and industrial applications.

BRIEF DESCRIPTION OF THE ACCOMPANYING DRAWINGS

SPECIFIC EMBODIMENTS OF THE INVENTION

Figure 1:
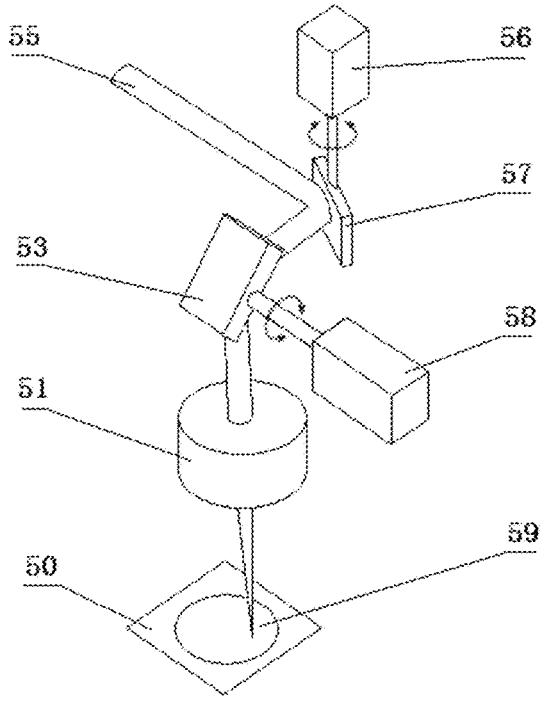
FIG. 1 is a schematic diagram of a scanning galvanometer with a rear f-θ focusing lens.

For clear understanding of the objectives, features and advantages of the invention, detailed description of the invention will be given below in conjunction with accompanying drawings and specific embodiments. It should be noted that the embodiments are only meant to explain the invention, and not to limit the scope of the invention.

The method of the present invention takes the advantage of high speed and high precision of the scanning galvanometer, adopts the method of heating on intermittent repeated scans instead of on a single scan in prior art for laser quenching, and increases the total inputted laser energy to make the temperature of the workpiece surface rise rapidly in a range below its melting point by controlling the duration of heating, the interval of two treatments and the scanning times of the laser quenching process on repeated scans, so that a larger depth of hardening can be realized by laser quenching of high power and high scanning speed as a result of thermal conduction and thermal accumulation.

Technical terms are illustrated as follows:

Processing unit: a region on a surface of a workpiece that is irradiated by a laser beam passing through a scanning galvanometer in a single continuous treatment under the condition of not moving the scanning galvanometer and the workpiece, wherein not moving the scanning galvanometer means the scanning galvanometer is not moved as a whole, not including the deflection of internal lenses, and laser energy distribution in a processing unit is substantially uniform.

Scanning period: the sum of the duration of a continuous treatment ($t_1$) and the interval of two treatments ($t_2$) by a laser beam applied to a processing unit, which is represented as $T_b$.

Quenching unit: a set of processing units irradiated by the laser beam within a scanning period, wherein a quenching unit comprises one or more processing units.

Scanning times: the repeated times of scanning a quenching unit required to reach a desired depth of hardening, which is represented as Q.

Quenching period: the product of scanning times and the scanning period within a quenching unit, which is represented as T.

Relative moving speed: the quotient of the time required for the laser beam moving from the initial position for irradiation of one quenching unit to that of its adjacent quenching unit divided by the distance between the initial position for irradiation of one quenching unit and that of its adjacent quenching unit when the workpiece includes multiple quenching units and the laser beam should move from one quenching unit to another. Relative moving speed can be realized by deflection of the scanning galvanometer, or by a mechanical motion mechanism driving the scanning galvanometer to move, or by a mechanical motion mechanism driving the workpiece to move, or by any combination of the above 3 ways of movement, wherein when the relative movement is continuous, the relative moving speed refers to the real time moving speed of the workpiece or the scanning galvanometer as a whole during laser quenching, or the actual speed of a laser quenching unit caused by the deflection of the scanning galvanometer while the scanning galvanometer is still; and when the relative movement is discontinuous, the relative moving speed refers to an average moving speed of a quenching unit caused by the workpiece or the scanning galvanometer as a whole, or by the deflection of the scanning galvanometer during laser quenching.

In present invention, laser energy distribution in a processing unit is substantially uniform, each of the processing unit is irradiated by a laser beam in an intermittent repeated manner, so that the workpiece surface will not melt by thermal accumulation of the total inputted laser energy, a laser quenching layer can be formed and a desired depth of hardening can be reached by cumulative effect of repeated heating.

A laser quenching process on repeated scans of the present invention can be realized by the steps of:

(1) assuming the total number of quenching units on said workpiece is N, the serial number of a quenching unit being processed on said workpiece is j, the quenching period is T, the required scanning times for a quenching unit is Q, and the actual scanning times is represented by q; and setting j=1, q=1, wherein laser energy distribution in a processing unit is substantially uniform in the whole process of laser quenching;

(2) irradiating an initial position of the jth quenching unit by said laser beam passing through said scanning galvanometer, and recording the time point as $t_0$, scanning each of the processing units in the jth quenching unit once by said laser beam, and proceeding to step (3) once finished;

(3) checking if q equals the predetermined scanning times Q, if yes, then quenching is finished for the jth quenching unit, namely laser transformation hardening has occurred and said desired depth of hardening is reached in each of the processing units in the jth quenching unit, and the process goes to step (4), and if no, q=q+1, setting the current time is t and the scanning period is $T_b$, and returning to step (2) when $t-t_0=T_b$; and once the duration of scanning the jth quenching unit once equals the scanning period $T_b$, a next cycle of scanning for the jth quenching unit is activated; and if the duration of scanning the jth quenching unit once is less than the scanning period $T_b$, wait until $t-t_0=T_b$ to activate a next cycle of scanning;

(4) checking if j equals N, if yes, then quenching is finished for all the quenching units, namely laser transformation hardening has occurred and a hardened region reaching said desired depth of hardening is formed by laser quenching in each of the quenching units, and the process goes to step (5), and if no, setting j=j+1 and returning to step (2); and (5) ending.

In step (1) illustrated above, the laser beam injected into the scanning galvanometer is called as the incident laser beam in the present invention; the beam size of the incident laser should be no more than the size of the inlet opening of the scanning galvanometer; the laser power actually used depends on the maximum power of the laser, the power density the scanning galvanometer can stand and the power density the workpiece can stand without melting during laser quenching; and the energy distribution of the incident laser beam can be Gauss mode or the flat-top mode, wherein the laser beam in the flat-top mode can help ensure the uniformity of depth and hardening so as to improve the quality of laser quenching.

In step (2) illustrated above, the laser beam scans according to predetermined process parameters including laser power, spot size, scanning speed, size of a processing unit, the duration of a continuous treatment $t_1$ in a processing unit, the interval of two treatments $t_2$ in a processing unit, etc. The scanning galvanometer of the present invention can be a scanning galvanometer with a front focusing lens or with a rear f-θ focusing lens.

As in FIG. 1, the structure of a scanning galvanometer with a rear f-θ focusing lens is as follows: an incident laser beam 55 deflected in sequence by an X-axis deflecting mirror 57 and a Y-axis deflecting mirror 53 is focused by an f-θ lens 51 on a focusing plane 50 to form a scanning region 59, wherein X-axis deflecting mirror 57 is driven by an X-axis motor 56, and Y-axis deflecting mirror 53 is driven by a Y-axis motor 58. The laser beam performs scanning in a large range of position driven by fast deflection of the scanning galvanometer. The f-θ lens 51 is an optical lens with optimized structural design, which can effectively compensate the difference of spot size and energy density from the center of the processing region to the edge of the processing region due to optical path difference, so as to improve the uniformity of laser power density in the scanning range of the scanning galvanometer.

Figure 2:
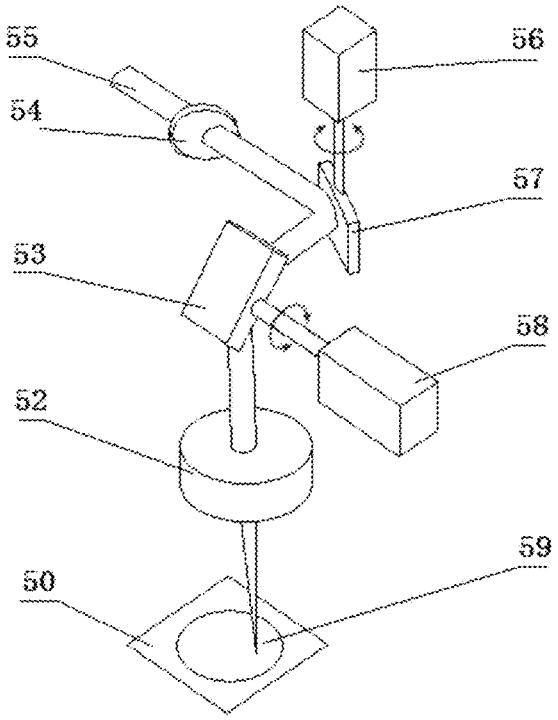
FIG. 2 is a schematic diagram of a scanning galvanometer with a front focusing lens.

As in FIG. 2, a scanning galvanometer with a front focusing lens includes a front focusing lens 54, X-axis deflecting mirror 57, Y-axis deflecting mirror 53, a protective mirror 52, X-axis motor 56 and Y-axis motor 58, wherein X-axis deflecting mirror 57 is mounted on X-axis motor 56, Y-axis deflecting mirror 53 is mounted on Y-axis motor 58, front focusing lens 54 is mounted in the optical path of incident laser beam 55, and protective mirror 52 is mounted in the optical path of light from Y-axis deflecting mirror 53.

The difference of the two structures is as follows: for the scanning galvanometer with a front focusing lens in FIG. 2, incident laser beam 55 is focused by front focusing lens 54, the movement of the focused beam is controlled by the scanning galvanometer for scanning, and protective mirror 52 instead of an f-θ lens is mounted on the outlet of the scanning galvanometer, wherein front focusing lens 54 can be a conventional optical focusing lens or a beam-shaping-focusing lens which can focus the laser beam and shape the laser beam in Gauss mode or other non-uniform modes into the laser beam with uniform energy, so as to obtain a desired laser quenching spot in the flat-top mode.

The spot size formed on the workpiece surface by the laser beam through the scanning galvanometer is generally selected by the size of the desired quenching region of the workpiece which can be a small light spot at the focusing point or a large light spot by defocusing. For a circular light spot, the spot size refers to its diameter, and for a light spot in rectangle shape or other shapes, the spot size refers to its side length.

One processing unit corresponds to one laser processing pattern, which can be a point, a line, or a plane, or be any other shapes such as an arc, a line segment, a circle, a rectangle, a square, a triangle, etc.

A quenching unit can be a single processing unit or a combination of multiple processing units. The pattern of a quenching unit can be a complex combined graphs formed by the patterns of the processing units or any other graphs which can be discrete, continuous or staggered.

One should be clear that the duration of heating does not equal the duty cycle of a conventional laser quenching process, and that the interval of two treatments does not mean that the laser does not output laser. More specifically, for a processing unit $B_1$, there may be no output laser or there is an output laser scanning one of the other processing units (such as $B_2$, $B_3$, etc.) during the interval of two treatments of $B_1$. The depth and hardness of hardened layer of processing unit $B_1$ is not affected by the thermal effect caused by the laser beam scanning processing unit $B_2$ or $B_3$. The laser processing pattern corresponding to a processing unit can be filled by scanning, or can be formed by direct irradiation of a focused light spot. If the pattern for laser processing is composed by simple discrete graph and the simple graph is fully consistent with the graph of the focused light spot, laser transformation hardening can occur and a desired depth of hardening can be reached in the processing unit by the focused light spot irradiating repeatedly for Q times instead of filling the pattern for laser processing. However, other patterns for laser processing such as a dot matrix, a line type or a plane type should be filled by scanning.

Figure 3:
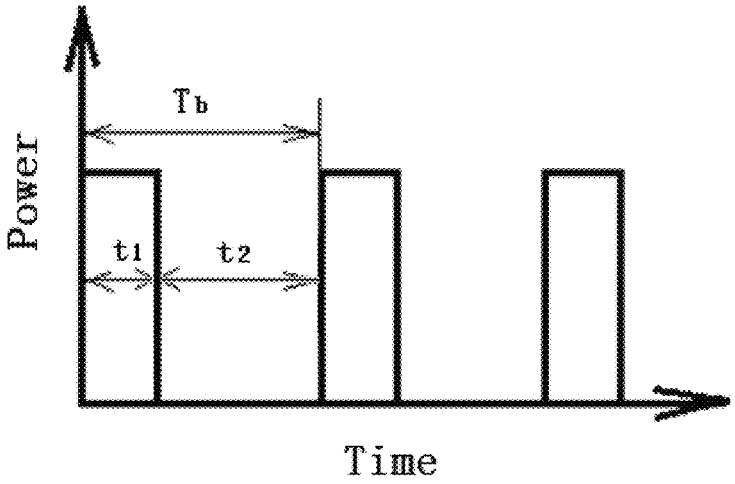
FIG. 3 is a schematic diagram of a scanning period by laser.

As mentioned before, the scanning period $T_b$ is the sum of the duration of a continuous treatment and the interval of two treatments by a laser beam applied to a processing unit, which is jointly determined by the scanning speed, the jumping speed and the acceleration of the scanning galvanometer and the way of the laser outputting a laser beam. As in FIG. 3, the duration of a continuous treatment $t_1$ is defined as the duration of a laser treating in one processing unit, and the interval of two treatments $t_2$ is defined as the interval before the laser beam returning the same processing unit. In other words, for a processing unit, the scanning period $T_b$ equals $t_1+t_2$.

The scanning process in a quenching process can be continuous or pulsed. Taking the advantage of high acceleration, high scanning speed and high jumping speed of the scanning galvanometer, multiple processing units can be processed simultaneously in a quenching period, which is favorable for improving the efficiency of laser quenching by high laser power and high relative moving speed.

The key of the present invention is that taking the advantage of repeated scanning, a greater depth of hardening can be obtained by laser quenching with higher laser power and higher scanning speed under the condition that no obvious melting occurs in the workpiece surface, or a higher productivity of laser quenching can be reached when obtaining the same depth of hardening. The process parameters can be selected according to the material type and the application of the workpiece for laser quenching, and to the type and the power of the laser used.

The laser of the present invention can be a fiber laser, a diode laser, a YAG laser, a disc laser or a $CO_2$ laser.

When a $CO_2$ laser is used for laser quenching, it is necessary to spray a special light-absorbing coating for $CO_2$ laser quenching (such as a $SiO_2$ coating, a graphite coating or other coatings with high absorption rate to 10.6 μm $CO_2$ laser) on the workpiece surface, and to perform laser quenching after the light-absorbing coating material is dried. However, when any one of a fiber laser, a diode laser, a YAG laser and a disc laser is used for laser quenching, laser quenching can be performed directly on the workpiece without any light-absorbing material, or can be performed by spraying a special light-absorbing material in advance.

When performing laser quenching on a workpiece demanding a large area of laser quenching, a flying laser quenching process on repeated scans can be employed to effectively improve the efficiency of laser quenching in order to avoid movement lags caused by frequent on-off operations on the mechanical motion device.

The flying laser quenching process on repeated scans is required to meet the following two requirements simultaneously: first, the workpiece keeps moving continuously at a relative moving speed v with respect to the scanning galvanometer as a whole; and second, each of the quenching units is scanned repeatedly by the laser beam. In order to meet the above two requirements, it is necessary for the scanning galvanometer to perform a compensatory motion during repeated scanning, which is further illustrated as follows. When the laser beam output by the scanning galvanometer quenches a quenching unit on repeated scans in a quenching period T, the workpiece keeps moving continuously at a relative moving speed v with respect to the scanning galvanometer as a whole, and at the same time, the laser beam output by the scanning galvanometer should move at a speed of −v reversely for compensation in the quenching period T, jump to a next quenching unit before the next quenching period T begins, and repeat the above process. As a result, it may guarantee that the actual effect of flying laser quenching on the workpiece surface on repeated scans with the scanning galvanometer is the same as with the scanning galvanometer still, frequent on-off operations on the mechanical motion device can be avoided, and the productivity of laser quenching can be further improved. The relative movement of the flying laser quenching process on repeated scans can be introduced by the movement of the workpiece, or the movement of the scanning galvanometer driven by a motion mechanism (also known as mechanical motion mechanism in present invention), or the movement of both. As long as a relative displacement occurs between the workpiece and the scanning galvanometer, the moving coordinates should be compensated in real time and a jumping distance of compensatory fly should be calculated. The speed of the compensatory motion of the laser beam passing through the scanning galvanometer has a value equal to the relative moving speed and a direction opposite to the relative moving speed.

Assume a coordinate system located on one of the workpiece and the mechanical motion mechanism is a reference coordinate system represented as (X, Y), another coordinate system located on the other of the workpiece and the mechanical motion mechanism is a motion coordinate system represented as (U,V), and the relative speed of the workpiece with respect to the mechanical motion mechanism at time t is $v_{xt}$ and $v_{yt}$ in the direction of x-axis and y-axis respectively. For each of the processing units, take the first point on the processing unit irradiated by the central point of the laser spot as a reference point A of the processing unit, wherein the reference point is represented as $A_0$ at time $t_0$, and the reference point is represented as A, at time t. It is known that the origin of the fixed coordinate system (X,Y) coincides with that of the motion coordinate system (U,V) at time $t_0$, so that the coordinate of the point $A_0$ of the processing unit at time $t_0$ in the motion coordinate system $(U_{A0},V_{A0})$ and that in the fixed coordinate system $(X_{t0},Y_{t0})$ are coincided which can be illustrated by formula (I):

$$\begin{cases} X_{t0} = U_{A0} \\ Y_{t0} = V_{A0} \end{cases} \tag{I}$$

The coordinate of the reference point $A_t$ at time t ($t>t_0$) in the motion coordinate system and that in the fixed coordinate system are coincided again, and the compensatory coordinate of the reference point $A_t$ of the processing unit at time t $(X_t,Y_t)$ is illustrated by formula (II):

$$\begin{cases} X_t = U_{A0} + \int_{t0} v_{xt}\,dt \\ Y_t = V_{A0} + \int_{t0} v_{yt}\,dt \end{cases} \tag{II}$$

In practical applications, the relative movement between the workpiece and the mechanical motion mechanism can occur only along the x-axis or the y-axis, and formula (II) can be simplified as formula (III):

$$\begin{cases} X_t = U_{A0} + \int_{t0} v_{xt}\,dt \\ Y_t = V_{A0} \end{cases} \text{ or } \begin{cases} X_t = U_{A0} \\ Y_t = V_{A0} + \int_{t0} v_{yt}\,dt \end{cases} \tag{III}$$

Formula (III) illustrates the scanning coordinate of flying laser quenching on repeated scans, and the jumping distance of compensatory fly at time t ($t>t_0$) is as follows:

$$S_t=\int_{t_0} v_{xt}dt \text{ or } S_t=\int_{t_0} v_{yt}dt \tag{IV}$$

Specifically, when employing the flying laser quenching process on repeated scans, the method of the present invention includes the following steps of:

(1) assuming the total number of quenching units on the workpiece is N, the serial number of a quenching unit being processed is j, the scanning period is $T_b$, the quenching period is T, the required scanning times for a quenching unit is Q, the actual scanning times is represented by q, the relative moving speed of the workpiece with respect to the scanning galvanometer as a whole is v, and the compensatory moving speed of the laser beam passing through the scanning galvanometer is-v; and setting j=1 and q=1, wherein laser energy distribution in a processing unit is substantially uniform in the whole process of laser quenching;

(2) irradiating an initial position of the jth quenching unit by said laser beam passing through said scanning galvanometer, and recording the time point as $t_0$, scanning each of the processing units in the jth quenching unit once by the laser beam while making the laser beam fly reversely at a speed of −v for compensation, and proceeding to step (3) once finished;

(3) assuming the present time is t, and checking if q equals the predetermined scanning times Q, if yes, then quenching is finished for the jth quenching unit, namely laser transformation hardening has occurred and the desired depth of hardening is reached in each of the processing units in the jth quenching unit, the duration of scanning the jth quenching unit equals the quenching period T, and the laser beam jumps to a next quenching unit immediately, wherein the jumping distance equals the jumping distance of compensatory fly illustrated in formula (IV) at time t, and the process goes to step (4); and if no, q=q+1, and returning to step (2) when $t-t_0=T_b$, wherein once the duration of scanning the jth quenching unit once equals the scanning period $T_b$, the laser beam jumps from the last processing unit to the first processing unit with a jumping distance equal to the jumping distance of compensatory fly illustrated in formula (IV) at time t and a next cycle of flying laser quenching on repeated scans for the jth quenching unit is activated; and if the duration of scanning the jth quenching unit once is less than the scanning period $T_b$, wait until $t-t_0=T_b$ to activate a next cycle of flying laser quenching on repeated scans;

(4) checking if j equals N, if yes, then laser transformation hardening has occurred and a hardened region reaching the desired depth of hardening is formed by laser quenching in each of the quenching units, and the process goes to step (5), and if no, setting j=j+1 and returning to step (2); and (5) ending.

Regardless of whether or not the flying compensatory process is employed, the essence of the method of the present invention is to perform laser quenching on intermittent repeated scans on each of the processing units by a laser beam passing through a scanning galvanometer so that melting in the workpiece surface caused by the total energy injected to the processing units can be avoided, a laser quenching layer can be formed by the cumulative thermal effect of repeated heating, and a desired depth of hardening can be reached. Any parameters of laser quenching process capable of realizing the above proposals can be used to implement the method of the present invention. Generally, when the laser power is 300~30000 W, the spot size is 0.5~60 mm, the scanning speed is 100-10000 mm/s, the size of the processing unit is 0.2~60000 $mm^2$, the scanning times is 2~10000, the duration of a laser treatment $t_1$ is 1~10000 ms, the interval of two treatments $t_2$ is 1~10000 ms, and the quenching period T is 2~200000 ms. when the laser power is 1000~20000 W, the spot size is 1~30 mm, the scanning speed is 300-8000 mm/s, the size of the processing unit is 1~30000 $mm^2$, the scanning times is 2~5000, the duration of a laser treatment $t_1$ is 1~1000 ms, the interval of two treatments $t_2$ is 1~1000 ms, and the quenching period T is 2~20000 ms. when the laser power is 1500~15000 W, the spot size is 2~15 mm, the scanning speed is 300-7000 mm/s, the size of the processing unit is 10~15000 $mm^2$, the scanning times is 2~3000, the duration of a laser treatment $t_1$ is 1~500 ms, the interval of two treatments $t_2$ is 1~500 ms, and the quenching period T is 2~10000 ms. when the laser power is 2000~10000 W, the spot size is 3~10 mm, the scanning speed is 300-5000 mm/s, the size of the processing unit is 15~10000 $mm^2$, the scanning times is 2~1000, the duration of a laser treatment $t_1$ is 1~300 ms, the interval of two treatments $t_2$ is 1~300 ms, and the quenching period T is 2~6000 ms.

Figure 4:
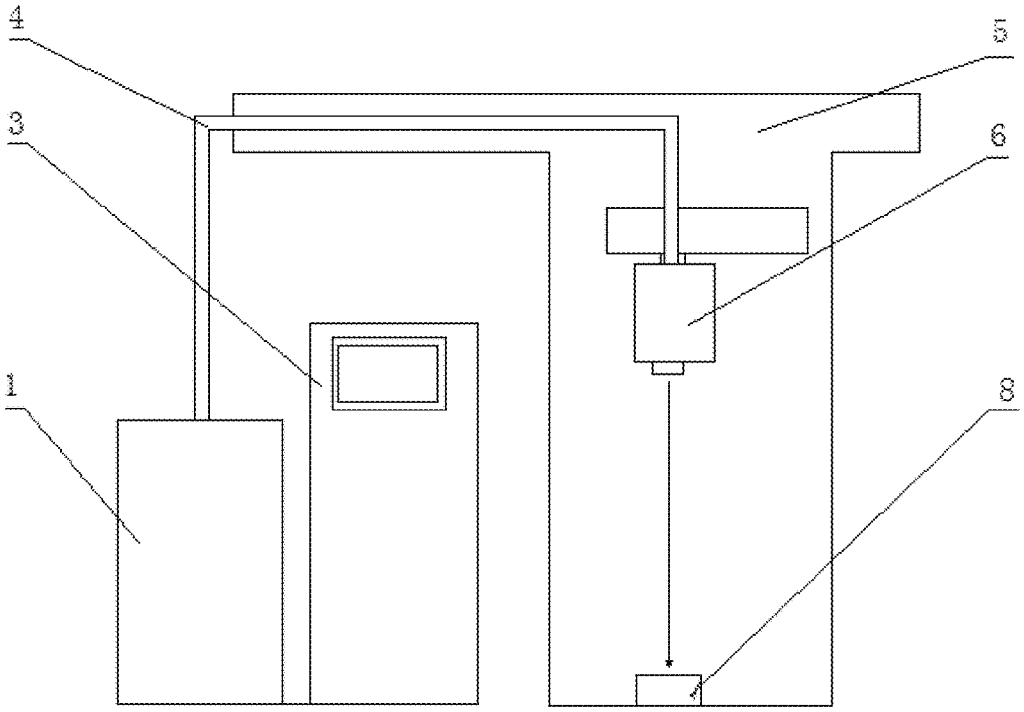
FIG. 4 is a schematic diagram of an apparatus for laser quenching based on a scanning galvanometer.

As in FIG. 4, an apparatus of the present invention comprises a laser 1, a control system 3, a light guiding system 4, a mechanical motion device 5, and a scanning galvanometer 6, wherein laser 1 is optically coupled to scanning galvanometer 6 via light guiding system 4; control system 3 is electrically coupled to laser 1, mechanical motion device 5 and scanning galvanometer 6 respectively to control their behavior; and mechanical motion device 5 is configured to drive scanning galvanometer 6 or a workpiece 8 to move along with it.

Scanning galvanometer 6 is a scanning galvanometer with a front focusing lens or with a rear f-θ focusing lens.

Mechanical motion device 5 is a motion mechanism such as a conventional machine tool, a CNC machine tool or a multi-joint robot (manipulator) which can be single-axis or multi-axis according to the requirements of actual processing.

Light guiding system 4 may be a fiber transmission system or a hard optical guiding system composed by a set of optical lens which transmits the laser beam of laser 1 to the inlet of scanning galvanometer 6.

The operating procedure of the apparatus of the present invention is as follows:

Step one: adjust scanning galvanometer 6 to the top of workpiece 8, and transmit the laser beam of laser 1 to the inlet of scanning galvanometer 6 via the light guiding system.

Step two: run scanning galvanometer 6 on the premise of not emitting a laser beam to make sure processing units or quenching units formed by programmed parameters (including the size of a processing unit, the scanning times, $t_1$, $t_2$, and the scanning period) consistent with the design.

Step 3: turn on laser 1, perform laser quenching on repeated scans by predetermined parameters of laser quenching process to form a laser quenching unit on the workpiece surface.

Step 4: mechanical motion device 5 drives scanning galvanometer 6 to move under the control of the control system to make the output laser beam irradiate a next quenching unit of the workpiece surface.

Step 5: repeat step 3 to 4 until traversing all the quenching units of the workpiece surface to form a laser transformation quenching layer in the workpiece surface.

The present invention can perform laser quenching hardening on a workpiece such as a large-scaled bearing ring, a large-scaled mold, a guide of a machine tool, a steel rail, etc. to significantly improve at least one of the depth and the efficiency of laser quenching.

Embodiments of the present invention are illustrated in combination with the figures below. One should be noted that illustration of the embodiments is for helping understanding the present invention and should not be misinterpreted as limitations of the present invention. Besides, technical features of the embodiments of the present invention illustrated below can combine with each other as long as there is no conflict.

Figure 5:
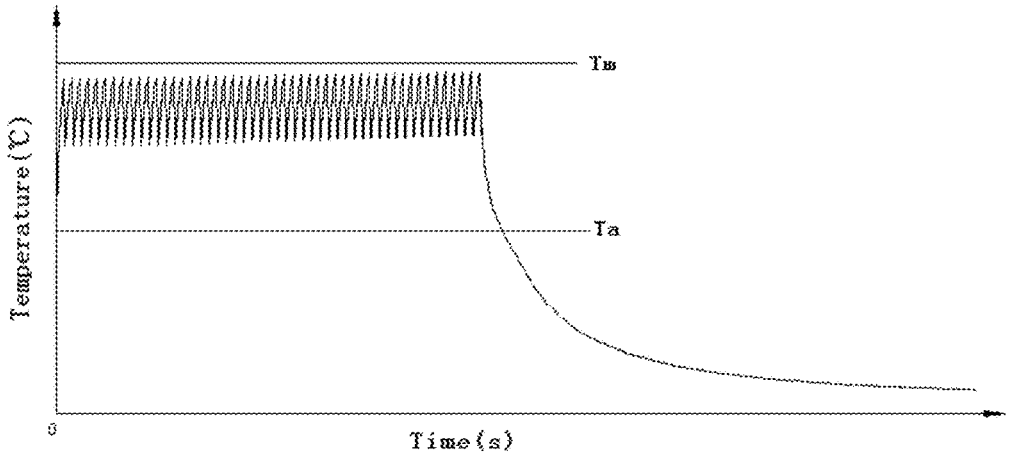
FIG. 5 shows a temperature curve of a workpiece surface during laser quenching according to embodiment 1 of the present invention.

Embodiment 1: A Laser Quenching Process on Repeated Scans Applied to Laser Quenching a Large-Scaled Gear A diode laser is employed to perform laser quenching on a large-scaled 42CrMo gear according to the embodiment. The spot size is Φ 6 mm, the laser power is 6000 W, the processing unit is a 6 mm×15 mm rectangle, the scanning speed is 1000 mm/s, the scanning times is 50, the duration of a continuous treatment $t_1$ is 0.015 s, the interval of two treatments $t_2$ is 0.0167 s, the quenching period T is 1.6 s, the relative moving speed is 400 mm/min, and the direction of the vector of the relative moving speed is perpendicular to the longitudinal direction of the processing unit. A quenched region with a width of 15 mm is obtained by single-track quenching without an overlap and the depth of hardening is 0.8 mm. The temperature curve of the workpiece surface during laser quenching on repeated high power scans is shown in FIG. 5.

Generally, no conventional motion mechanism can reach such a high scanning speed by processes in prior art with the power and the light spot mentioned above, so it's impossible to realize laser quenching with a power of 6000 W, and low-powered laser quenching should be employed to assure no melting in the workpiece surface. Preferred processing parameters of laser quenching in prior art are as follows: the laser power is 2000 W, the spot size is D 6 mm, and the relative moving speed is 300 mm/min. A quenched region with a width of only 6 mm is obtained by single-track quenching with an overlap of 1.5 mm, and the depth of the hardening on a single scan is 0.8 mm.

The overlap refers to the width of tempering effect between two adjacent quenching units, which can be 0 to 3 mm.

As for the workpiece of the embodiment, the total processing time consumed by the process of the embodiment is approximately ⅓ of that of the process in prior art.

Figure 6:
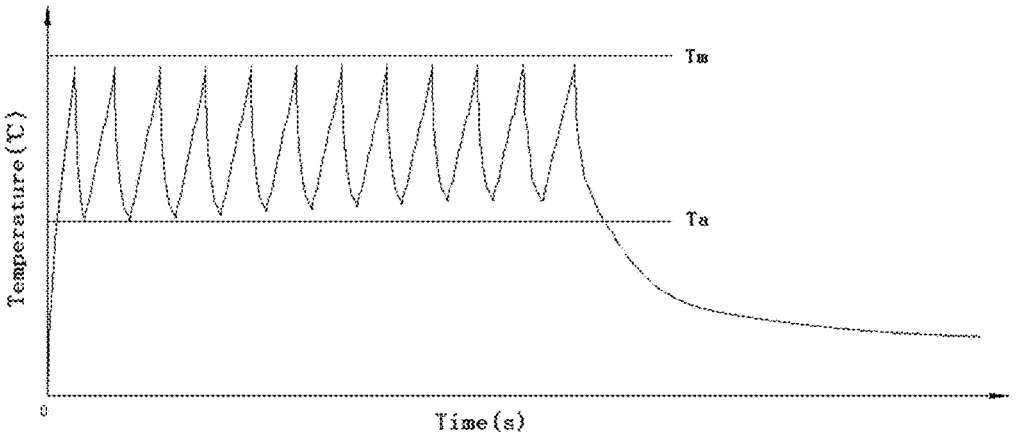
FIG. 6 shows a temperature curve of a workpiece surface during laser quenching according to embodiment 2 of the present invention.

Embodiment 2: A Laser Quenching Process on Repeated Scans Applied to Laser Quenching a Large-Scaled Roll A $CO_2$ laser with a wavelength of 10.6 μm is employed to perform laser quenching on a large-scaled 75CrMnMo roll according to the embodiment. The spot size is Φ5 mm, the laser power is 8000 W, the processing unit is a 5 mm×35 mm rectangle, the scanning speed is 350 mm/s, the scanning times is 12, the duration of a continuous treatment $t_1$ is 0.1 s, the interval of two treatments $t_2$ is 0.125 s, the quenching period T is 2.7 s, the relative moving speed is 300 mm/min, and the direction of the vector of the relative moving speed is perpendicular to the longitudinal direction of the processing unit. A quenched region with a width of 35 mm is obtained by single-track quenching with an overlap of 2 mm Spray a special $SiO_2$ light-absorbing material on the workpiece surface before laser quenching, and start laser quenching until the light-absorbing material is dried. The depth of hardening can reach 1.0 mm by laser quenching by filling. The temperature curve of the workpiece surface during laser quenching on repeated high power scans is shown in FIG. 6.

Similarly to embodiment 1, preferred processing parameters of laser quenching in prior art are as follows: the laser power is 1000 W, the spot size is Φ5 mm, and the relative moving speed is 600 mm/min. A quenched region with a width of only 5 mm is obtained by single-track quenching with an overlap of 1 mm Spray a special $SiO_2$ light-absorbing material on the workpiece surface before laser quenching, and start laser quenching until the light-absorbing material is dried. The depth of hardening can reach 0.6 mm by laser quenching on a single scan. As for the workpiece of the embodiment, the total processing time consumed by the process of the embodiment is approximately ¼ of that of the process in prior art, and the depth of hardening is approximately 1.67 times of that of the process in prior art.

Figure 7:
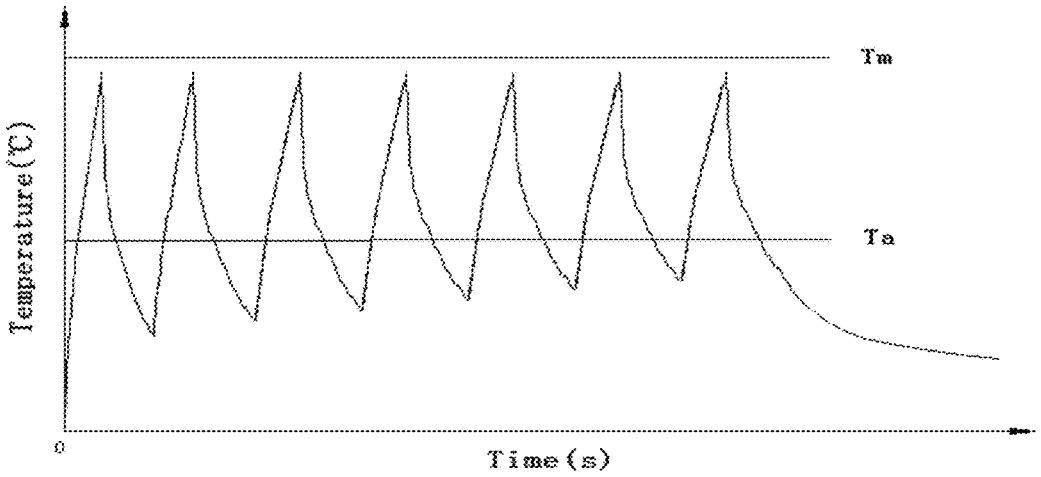
FIG. 7 shows a temperature curve of a workpiece surface during laser quenching according to embodiment 3 of the present invention.

Embodiment 3: A Laser Quenching Process on Repeated Scans Applied to Laser Quenching a Large-Scaled Mold A fiber laser is employed to perform laser quenching on a large-scaled 50CrNiMo mold according to the embodiment. The spot size is 6 mm×6 mm, the laser power is 12000 W, the processing unit is a 6 mm×140 mm rectangle, the scanning speed is 420 mm/s, the scanning times is 7, the duration of a continuous treatment $t_1$ is 0.333 s, the interval of two treatments $t_2$ is 0.349 s, the quenching period T is 4.8 s, the relative moving speed is 300 mm/min, and the direction of the vector of the relative moving speed is perpendicular to the longitudinal direction of the processing unit. A quenched region with a width of 140 mm is obtained by single-track quenching and the depth of hardening is 0.6 mm. The temperature curve of the workpiece surface during laser quenching on repeated high power scans is shown in FIG. 7.

Similarly to embodiment 1, melting in a workpiece surface occurs if a laser quenching process in prior art with a laser power of 12000 W is employed. Preferred processing parameters of laser quenching in prior art are as follows: the laser power is 1200 W, the spot size is 6 mm×6 mm, and the relative moving speed is 600 mm/min. A quenched region with a width of only 6 mm is obtained by single-track quenching with an overlap of 1 mm, and the depth of hardening is 0.6 mm.

The total productivity of the process of the embodiment is approximately 12 times of that of the process in prior art.

Figure 8:
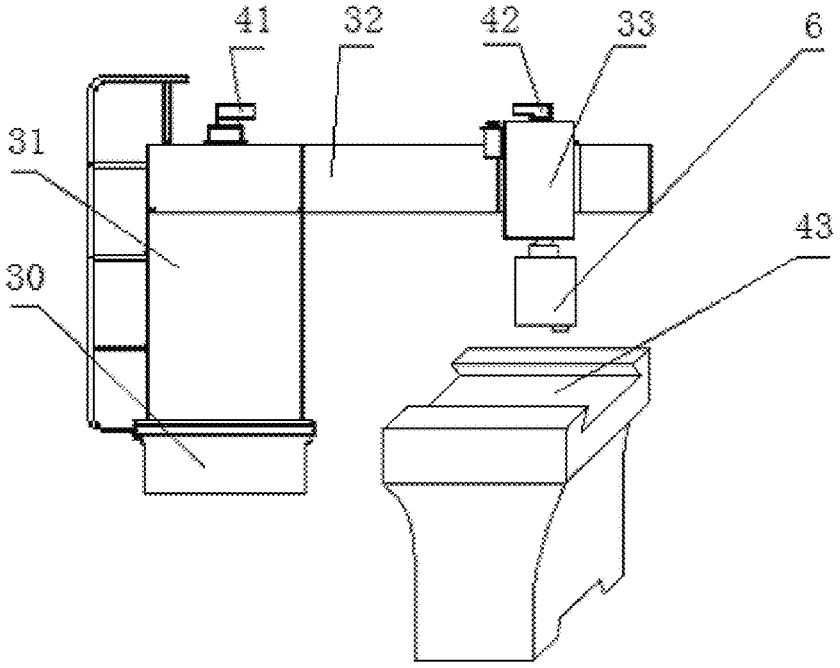
FIG. 8 illustrates applying a laser quenching process on repeated scans to a large-scaled mold according to embodiment 3 of the present invention.

The specific process of realizing embodiment 3 is illustrated in FIG. 8. A CNC machine tool comprises an x-axis 30, a column 31, a y-axis 32 and a z-axis 33.

A 45° reflective device 41 is mounted on y-axis 32, a 45° reflective device 42 is mounted on z-axis 33, and a scanning galvanometer 6 is fixed on z-axis 33 of the CNC machine tool. The input laser beam from the direction of x-axis 30 is reflected by reflective device 41 and is transmitted to reflective device 42, which is then reflected by reflective device 42 and is transmitted to the inlet of scanning galvanometer 6.

During laser quenching, x-axis 30 and z-axis 33 are fixed, y-axis 32 drives z-axis 33 and scanning galvanometer 6 to move by a predetermined program, and a large-scaled mold 43 is efficiently quenched by the laser beam from scanning galvanometer 6 on repeated scans.

Embodiment 4: A Laser Quenching Process on Repeated Scans Applied to Laser Quenching a Bearing Ring A solid-state laser with a wavelength of 1070 μm is employed to perform laser quenching on a large-scaled 42CrMo bearing ring according to the embodiment. The spot size is 7 mm×7 mm, the laser power is 5000 W, the processing unit is a 20 mm×20 mm rectangle, the scanning speed is 2000 mm/s, the scanning times is 180, the duration of a continuous treatment $t_1$ is 0.02 s, the interval of two treatments $t_2$ is 0.024 s, the quenching period T is 7.92 s, the relative moving speed is 152 mm/min, and the direction of the vector of the relative moving speed is perpendicular to the longitudinal direction of the processing unit. A quenched region with a width of 20 mm is obtained by single-track quenching without an overlap and the depth of hardening is 2.0 mm.

Figure 9:
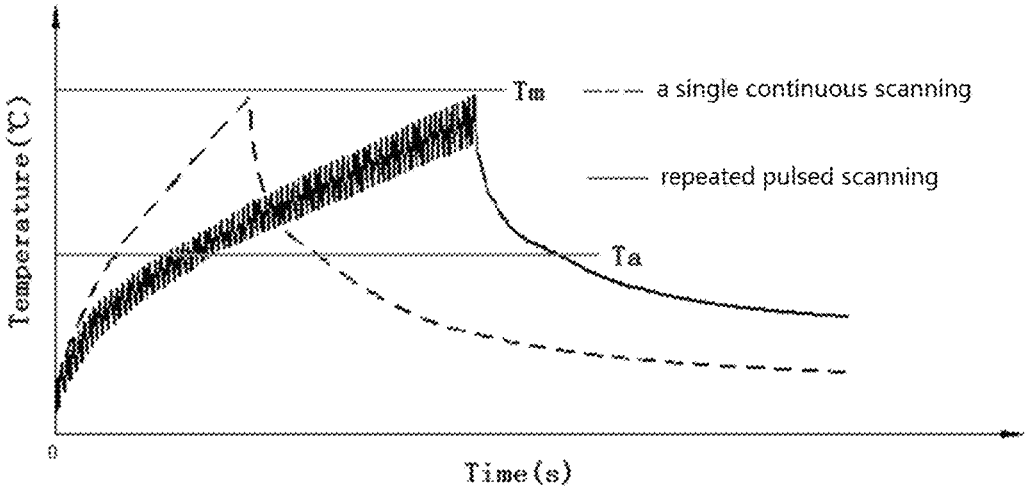
FIG. 9 shows a temperature curve of a workpiece surface during laser quenching on a single continuous scan and that on repeated pulse scans respectively according to embodiment 4 of the present invention.

Similarly to embodiment 1, preferred processing parameters of laser quenching in prior art are as follows: the laser power is 2000 W, the spot size is 7 mm×7 mm, and the relative moving speed is 300 mm/min. A quenched region with a width of only 7 mm is obtained by single-track quenching with an overlap of 1.5 mm, and the depth of hardening is 1.0 mm. The temperature curve of the workpiece surface during laser quenching on a single continuous scan and that on repeated pulse scans respectively are shown in FIG. 9.

The depth of hardening of the embodiment is 2 times of that of the conventional laser quenching process on a single scan in the same processing time.

Figure 10:
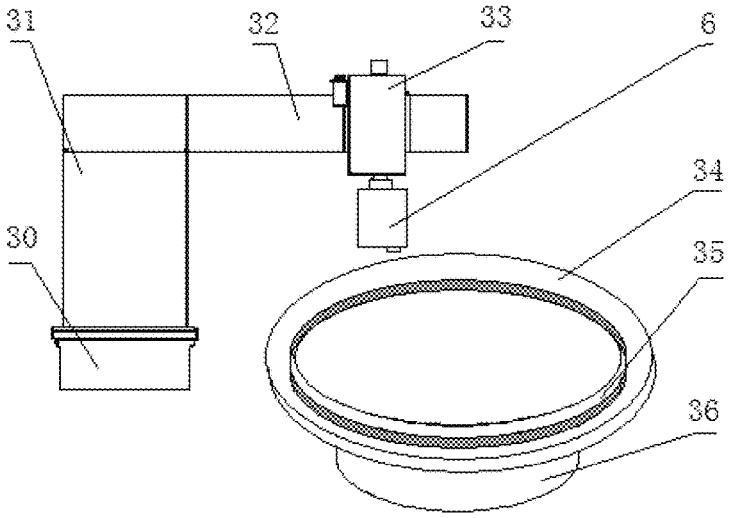
FIG. 10 illustrates applying a laser quenching process on repeated scans to a large-scaled bearing ring according to embodiment 4 of the present invention.

The specific process of realizing embodiment 4 is illustrated in FIG. 10. A CNC machine tool comprises x-axis 30, column 31, y-axis 32, z-axis 33, and a vertical rotary axis 36. A bearing ring 35 is supported and positioned by a special tray 34, which is fixed on vertical rotary axis 36, and scanning galvanometer 6 is fixed on z-axis 33. During laser quenching, x-axis 30, y-axis 32 and z-axis 33 are in a fixed position, bearing ring 35 is driven to rotate by rotating vertical rotary axis 36 according to predetermined process parameters, and bearing ring 35 is quenched by the laser beam from scanning galvanometer 6 on repeated scans.

Embodiment 5: A Laser Quenching Process on Repeated Scans Applied to Laser Quenching a Railway Steel Rail A diode laser is employed to perform laser quenching on the surface of a 71Mn steel rail according to the embodiment wherein the pattern for laser processing is a dot matrix. The spot size is 10 mm×10 mm, the laser power is 6000 W, the size of each of the processing units equals the spot size, the distance between two adjacent processing units is 5 mm, the scanning times is 90, the duration of a continuous treatment $t_1$ is 0.004 s, the interval of two treatments $t_2$ is 0.0105 s, a quenching unit is composed by two processing units arranged as a 1×2 array, the quenching period T is 1.3 s, and the relative moving speed (average speed) is 1384 mm/min. The depth of hardening can reach 0.8 mm.

Similarly to embodiment 1, preferred processing parameters of laser quenching on a single scan in prior art are as follows: the laser power is 3000 W, the spot size is 10 mm×10 mm, the distance between two adjacent processing units is 5 mm, the duration of quenching is 1.5 s, and the relative moving speed (average speed) is 600 mm/min. The depth of hardening can reach 0.8 mm.

The total processing time of the embodiment is approximately ½ of that of the process in prior art.

Embodiment 6: A Laser Quenching Process on Repeated Scans Applied to Laser Quenching a Guide of a Machine Tool A method of flying laser quenching on repeated scans is provided in the present invention to solve the problem of low productivity of laser quenching discrete graphs in prior art, which is a flying laser quenching process on repeated scans implemented in the following three ways: the workpiece is fixed while the scanning galvanometer is moving; the scanning galvanometer is fixed while the workpiece is moving; and both the workpiece and the galvanometer is moving. A fiber laser is employed to perform laser quenching on repeated scans on the surface of a 40Cr guide of a machine tool which is a long strip according to the embodiment wherein the pattern for laser processing is a discrete dot matrix.

The spot size is 8 mm×8 mm, the size of each of the processing units equals the spot size, a quenching unit is composed by four processing units arranged as a 1×4 array, the distance between two adjacent processing units is 4 mm, the laser power is 8000 W, the scanning times is 253, the duration of a continuous treatment $t_1$ is 0.001 s, the interval of two treatments $t_2$ is 0.003 s, the quenching period T is 1.01 s, and the relative moving speed is 2860 mm/min, the compensatory speed of the laser beam from the scanning galvanometer is −2860 mm/min. The depth of hardening can reach 0.8 mm. Similarly to embodiment 1, preferred processing parameters of laser quenching on a single scan in prior art are as follows: the laser power is 2000 W, the spot size is 8 mm×8 mm, the distance between two adjacent processing units is 4 mm, the duration of quenching is 1 s, and the relative moving speed (average speed) is 430 mm/min. The depth of hardening can reach 0.8 mm.

The total processing time of the embodiment is approximately 1/7 of that of the process in prior art.

Figure 11:
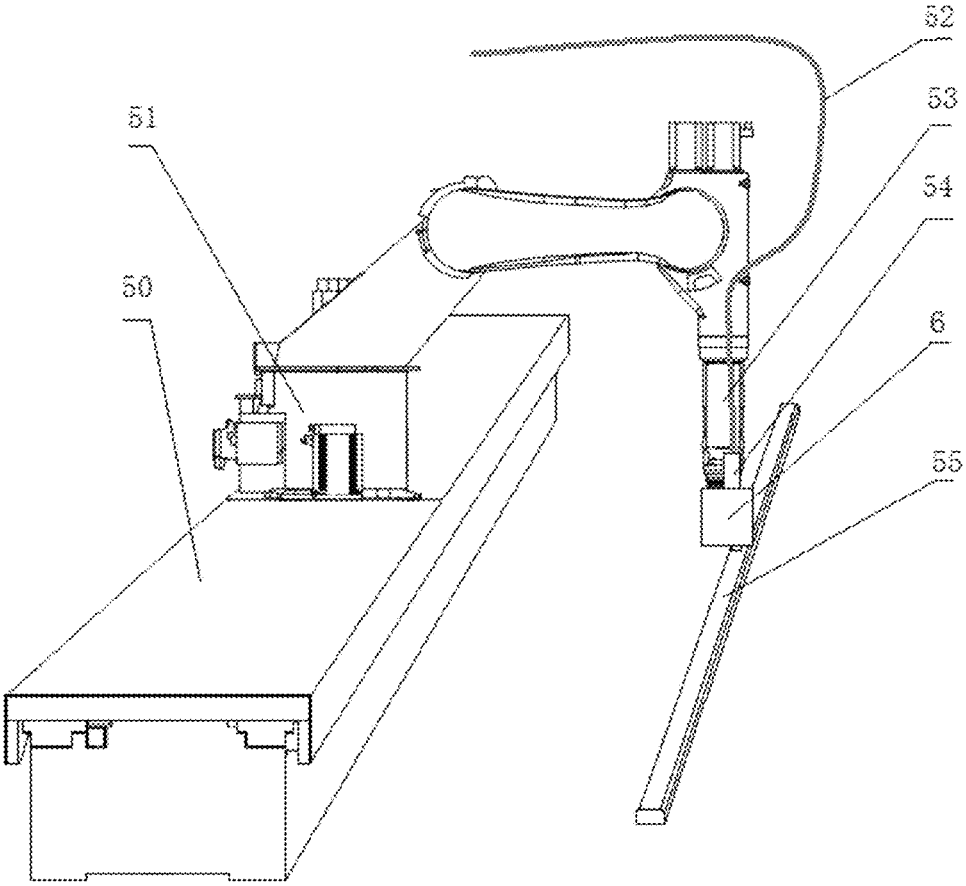
FIG. 11 illustrates applying a flying laser quenching process on repeated scans to a guide of a machine tool according to embodiment 6 of the present invention.

The specific process of performing flying laser quenching on repeated scans on a guide of a machine tool is illustrated in FIG. 11. A CNC laser processing system includes an industrial robot (manipulator) 51, an external motive X-axis component 50, a fiber transmission system 52, a beam-expanding system 54 and scanning galvanometer 6. Industrial robot (manipulator) 51 is fixed on external motive x-axis component 50, and scanning galvanometer 6 is fixed on a front arm 53 of industrial robot (manipulator) 51. A laser beam is transmitted to scanning galvanometer 6 via fiber transmission system 52 and beam-expanding system 54. During laser quenching, each motive axis of industrial robot (manipulator) 51 is fixed in a predetermined position, external motive x-axis component 50 drives industrial robot (manipulator) 51 and scanning galvanometer 6 to move, and the laser beam from scanning galvanometer 6 performs flying laser quenching on repeated scans on a guide of a machine tool 55.

Embodiment 7

A fiber laser is employed to perform laser quenching on a small GCr15 bearing ring according to the embodiment. The spot size is Φ3 mm, the laser power is 500 W, the size of each of the processing units is 3 mm×6 mm, the scanning speed is 1000 mm/s, the scanning times is 120, the duration of a continuous treatment $t_1$ is 0.006 s, the interval of two treatments $t_2$ is 0.0067 s, the quenching period T is 1.52 s, the relative moving speed (average speed) is 400 mm/min, the direction of the vector of the relative moving speed is parallel to the longitudinal direction of the processing unit without an overlap, and the depth of hardening can reach 0.5 mm. Preferred processing parameters of laser quenching on a single scan in prior art are as follows: the laser power is 300 W, the spot size is Φ3 mm, and the relative moving speed is 400 mm/min. The depth of hardening can reach 0.3 mm. The depth of hardening of the embodiment is 1.7 times of that of the conventional laser quenching process on a single scan in the same processing time.

Embodiment 8

A fiber laser is employed to perform laser quenching on a 50CrNiMo automobile mold, wherein the pattern for laser processing is a dot matrix. According to the embodiment, the spot size is 7×7 mm, the size of each of the processing units equals the spot size, the distance between two adjacent processing units is 3.5 mm, a quenching unit is composed by three processing units arranged as a 1×3 array, the duration of a continuous treatment $t_1$ is 0.004 s, and the interval of two treatments $t_2$ is 0.008 s. Processing parameters of laser quenching on repeated scans is as follows: the laser power is 2000~6000 W, the scanning times is 25~483, the quenching period is 0.3~5.8 s, the relative moving speed is 110~2000 mm/min, and the corresponding depth of hardening is 0.3~1.5 mm.

Figure 12:
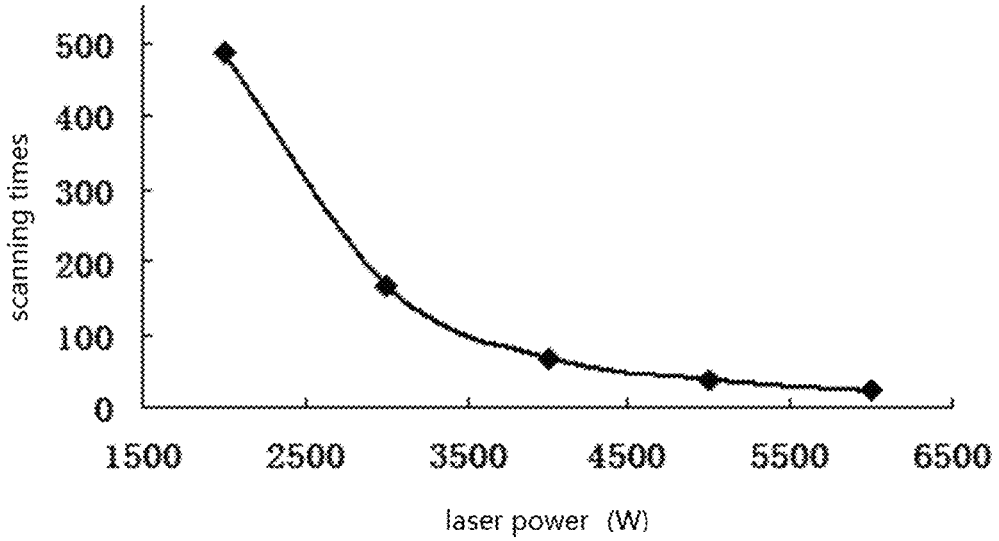
FIG. 12 illustrates the relationship between scanning times and laser power during a laser quenching process on repeated scans according to embodiment 8 of the present invention.
Figure 13:
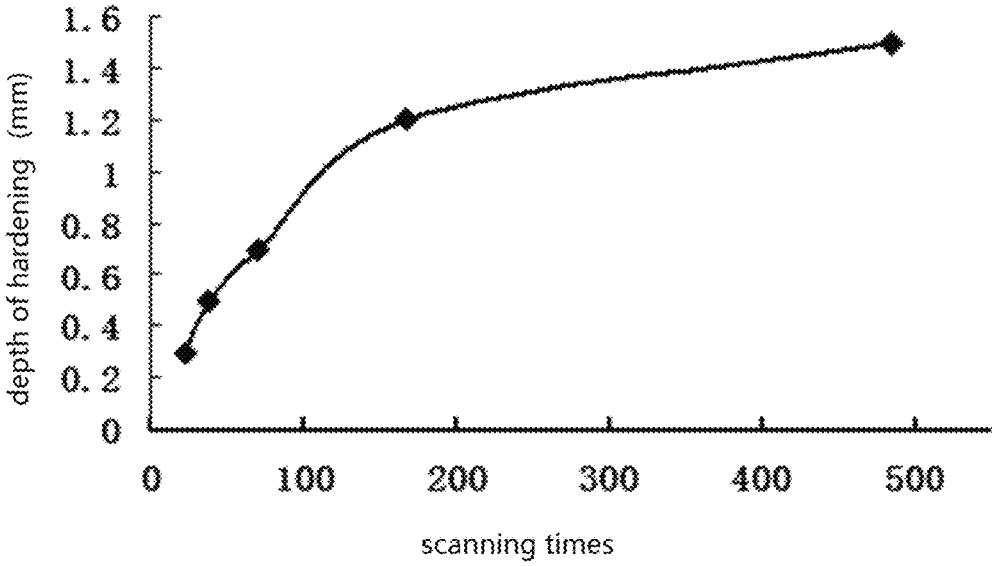
FIG. 13 illustrates the relationship between scanning times and the depth of hardening during a laser quenching process on repeated scans according to embodiment 8 of the present invention.

The influence of the processing parameters on the depth of hardening is shown in Table 1. The laser power has a significant influence on the scanning times. As shown in FIG. 12, the scanning times decreases from 483 to 25 and the relative moving speed (average speed) increases from 110 mm/min to 2000 mm/min when the laser power increases from 2000 W to 6000 W. The influence of the scanning times on the depth of hardening while the above processing parameters are fixed is shown in FIG. 13. The corresponding depth of hardening decreases from 1.5 mm to 0.3 mm when the scanning times decreases from 483 to 25.

TABLE 1 the influence of the processing parameters on the depth of hardening

| laser power (W) | scanning times | quenching period (s) | relative moving speed (mm/min) | depth of hardening (mm) |
|---|---|---|---|---|
| 2000 | 483 | 5.8 | 110 | 1.5 |
| 3000 | 167 | 2.0 | 310 | 1.2 |
| 4000 | 67 | 0.8 | 750 | 0.7 |
| 5000 | 40 | 0.48 | 1400 | 0.5 |
| 6000 | 25 | 0.3 | 2000 | 0.3 |

Generally, when performing laser quenching on a workpiece of certain material for the first time, one can obtain a preferred set of processing parameters by performing laser quenching on one of the quenching units of a sample or a workpiece and check if the roughness of the surface of the hardened layer and the depth of hardening are qualified, if yes, the processing parameters are qualified, and if no, the processing parameters should be adjusted until they are qualified.

While preferred embodiments of the invention have been described above, the invention is not limited to disclosure in the embodiments and the accompanying drawings. Any changes or modifications without departing from the spirit of the invention fall within the scope of the invention.

What is claimed is:

1. A method for quenching a surface of a metal workpiece by intermittent, repeated laser scanning, the method comprising:

providing a metal workpiece having a surface comprising one or more quenching units, wherein each quenching unit comprises one or more processing units, wherein a processing unit is a region to be irradiated on said surface of said metal workpiece, and wherein each processing unit has a laser processing pattern;

sequentially irradiating each of the processing units one by one, in each case via intermittent repeated scans using a high-power laser beam having a power density passing through a galvanometer, wherein each of the processing units is irradiated in a single treatment without moving said galvanometer to scan said workpiece, to result in a laser quenching process; and wherein each scan has a duration during which one of the processing units is irradiated, followed by a time interval between scans during which the processing unit is not irradiated, thereby providing for intermittent repeated laser scanning on each processing unit, and a quenched surface of a metal workpiece with improved quenching depth, and wherein said laser quenching process has parameters comprising laser power and spot size, and wherein the laser power is 300 W-30,000 W and the spot size is 0.5 mm-60 mm.

2. The method of claim 1, wherein said laser quenching process parameters comprise scanning speed, scanning period, and number of scans, wherein the scanning speed is 300 mm/s-8000 mm/s, said scanning period refers to a sum of a continuous radiation time during which said laser beam is applied to a processing unit and the time interval between scans, during which the processing unit is not irradiated before a subsequent scan, said number of scans refers to the number of times a quenching unit is scanned to reach a desired depth of hardening, wherein the number of scans is 2-5000, and the size of the processing unit is 1 $mm^2$-30,000 $mm^2$.

3. The method of claim 1, further comprising moving the workpiece at a speed with respect to the galvanometer, wherein said laser quenching process parameters further comprise a relative moving speed, to provide for flight repeated scanning laser quenching.

4. The method of claim 2, wherein a total number of quenching units on said workpiece is N, a serial number of a quenching unit being processed on said workpiece is j, a quenching period is T, a predetermined number of scans for a quenching unit is Q, and an actual number of scans is q, where said quenching period T equals the product of the number of scans and the scanning period within a quenching unit; and wherein the method further comprises:

(1) initially setting j=1, and q=1;

(2) irradiating an initial position of the jth quenching unit by passing said laser beam through said galvanometer, at an initial time point $t_0$, scanning each of the processing units in the jth quenching unit once by said laser beam, and proceeding to step (3) once finished, wherein laser energy distribution in a processing unit is substantially uniform throughout the laser quenching process;

(3) checking if q equals the predetermined number of scanning times Q, if yes, then quenching is finished for the jth quenching unit, namely laser transformation hardening has occurred and a desired depth of hardening is reached in each of the processing units in the jth quenching unit, and proceeding to step (4), and if no, q=q+1, setting the current time to t and the scanning period to $T_b$, and returning to step (2) when $t-t_0=T_b$;

(4) checking if j equals N, if yes, then laser transformation hardening has occurred and a hardened region reaching said desired depth of hardening is formed by laser quenching in each of the quenching units, and proceeding to step (5), and if no, setting j=j+1 and returning to step (2); and (5) ending the laser quenching process.

5. The method of claim 3, wherein a total number of quenching units on said workpiece is N, a serial number of a quenching unit being processed on said workpiece is j, a predetermined number of scans for a quenching unit is Q, a quenching period is T, an actual number of scans is q, a relative moving speed is v, and a compensatory moving speed of the laser beam passing through the galvanometer is −v, where said quenching period T equals the product of the number of scans and the scanning period within a quenching unit, and wherein the method further comprises:

(1) initially setting j=1 and q=1;

(2) irradiating an initial position of the jth quenching unit by passing said laser beam passing through said galvanometer, at an initial time point $t_0$, scanning each of the processing units in the jth quenching unit once by said laser beam according to a predetermined scanning speed while said laser beam moves at a speed of −v for compensation, and proceeding to step (3) once finished, wherein laser energy distribution in a processing unit is substantially uniform throughout the laser scanning process;

(3) checking if q equals the predetermined number of scanning times Q, if yes, then quenching is finished for the jth quenching unit, namely laser transformation hardening has occurred and a desired depth of hardening is reached in each of the processing units in the jth quenching unit, and proceeding to step (4), and if no, q=q+1, setting the current time to t and the scanning period to $T_b$, and returning to step (2) when $t-t_0=T_b$, wherein once the duration of scanning the jth quenching unit equals said scanning period $T_b$, said laser beam jumps from a final processing unit to an initial processing unit to begin a subsequent cycle of laser quenching for the jth quenching unit, wherein the laser beam jumps a distance as calculated by formula IV at time $T_b$; and if the duration of scanning the jth quenching unit once is less than said scanning period $T_b$, wait until $t-t_0=T_b$ to activate a next cycle of laser quenching on repeated scans;

(4) checking if j equals N, if yes, then quenching is finished for all the quenching units, whereby laser transformation hardening has occurred, and a hardened region reaching said desired depth of hardening is formed by laser quenching in each of the quenching units, and proceeding to step (5), and if no, setting j=j+1 and returning to step (2); and (5) ending.

6. The method of claim 4, wherein the duration of laser irradiation during a scan $t_1$ is 1-10,000 ms, the time interval between scans $t_2$ is 1-10,000 ms, and the quenching period T is 2-200,000 ms.

7. The method of claim 5, wherein the duration of laser irradiation during a scan $t_1$ is 1-10,000 ms, the time interval between scans $t_2$ is 1-10,000 ms, and the quenching period T is 2-200,000 ms.

8. The method of claim 4, wherein the laser power is 1000-20,000 W, the spot size is 1-30 mm, the scanning speed is 300-8000 mm/s, the size of the processing unit is 1-30,000 $mm^2$, the number of scans is 2-5000, the duration of laser irradiation during a scan $t_1$ is 1-1000 ms, the time interval between scans $t_2$ is 1-1000 ms, and the quenching period T is 2-20,000 ms.

9. The method of claim 5, wherein the laser power is 1000-20,000 W, the spot size is 1-30 mm, the scanning speed is 300-8000 mm/s, the size of the processing unit is 1-30,000 $mm^2$, the number of scans is 2-5000, the duration of laser irradiation during a scan $t_1$ is 1-1000 ms, the time interval between scans $t_2$ is 1-1000 ms, and the quenching period T is 2-20,000 ms.

10. The method of claim 4, wherein the laser power is 1500-15000 W, the spot size is 2-15 mm, the scanning speed is 300-7000 mm/s, the size of the processing unit is 10-15000 $mm^2$, the number of scans is 2-3000, the duration of laser irradiation during a scan $t_1$ is 1-500 ms, the time interval between scans $t_2$ is 1-500 ms, and the quenching period T is 2-10,000 ms.

11. The method of claim 5, wherein the laser power is 1500-15000 W, the spot size is 2-15 mm, the scanning speed is 300-7000 mm/s, the size of the processing unit is 10-15000 $mm^2$, the number of scans is 2-3000, the duration of laser irradiation during a scan $t_1$ is 1-500 ms, the time interval between scans $t_2$ is 1-500 ms, and the quenching period T is 2-10,000 ms.

12. The method of claim 4, wherein the laser power is 2000-10,000 W, the spot size is 3-10 mm, the scanning speed is 300-5000 mm/s, the size of the processing unit is 15-10,000 $mm^2$, the number of scans is 2-1000, the duration of laser irradiation during a scan $t_1$ is 1-300 ms, the time interval between scans $t_2$ is 1-300 ms, and the quenching period T is 2-6000 ms.

13. The method of claim 5, wherein the laser power is 2000-10,000 W, the spot size is 3-10 mm, the scanning speed is 300-5000 mm/s, the size of the processing unit is 15-10,000 $mm^2$, the number of scans is 2-1000, the duration of laser irradiation during a scan $t_1$ is 1-300 ms, the time interval between scans $t_2$ is 1-300 ms, and the quenching period T is 2-6000 ms.

* * * * *